United States Patent [19]

Gendler

[11] Patent Number: 4,457,831

[45] Date of Patent: Jul. 3, 1984

[54] TWO-STAGE CATALYTIC HYDROCONVERSION OF HYDROCARBON FEEDSTOCKS USING RESID RECYCLE

[75] Inventor: Jeffrey L. Gendler, Richboro, Pa.

[73] Assignee: HRI, Inc., Gibbsboro, N.J.

[21] Appl. No.: 409,203

[22] Filed: Aug. 18, 1982

[51] Int. Cl.[3] ..... C10G 47/26

[52] U.S. Cl. ..... 208/59; 208/157; 208/158; 208/161; 208/162; 208/251 R

[58] Field of Search ..... 208/59, 157, 158, 161, 208/162, 251 R

[56] References Cited

U.S. PATENT DOCUMENTS

| | | | |
|---|---|---|---|
| 3,412,010 | 11/1968 | Alpert et al. | 208/112 |
| 3,418,234 | 12/1968 | Chervenak et al. | 208/59 |
| 3,844,933 | 10/1974 | Wolk et al. | 208/59 |
| 3,870,623 | 3/1973 | Johnson et al. | 208/108 |
| 3,893,911 | 7/1975 | Rovesti et al. | 208/251 H |
| 3,901,792 | 8/1975 | Wolk et al. | 208/210 |
| 3,910,834 | 10/1975 | Anderson | 208/59 |
| 4,271,007 | 6/1981 | Souhradaa | 208/48 R |

*Primary Examiner*—Patrick Garvin
*Assistant Examiner*—George Schmitkons
*Attorney, Agent, or Firm*—F. A. Wilson; V. A. Mallare

[57] ABSTRACT

A two-stage catalytic hydroconversion process for heavy hydrocarbon feedstocks usually containing fine particulate solids to produce lower boiling hydrocarbon liquid and gas products. The feedstock is fed into a first stage ebullated bed reactor containing fine sized catalyst and operated at moderate reaction conditions for hydroconversion to produce hydrocarbon gas and liquid fractions, from which a low boiling liquid fraction is separated and withdrawn as a product. The remaining gas and heavier liquid fractions are recombined and fed to a second stage ebullated bed reactor containing larger size catalyst for further hydroconversion reactions at less severe conditions to produce lower boiling hydrocarbon liquid fractions. Following product distillation steps, liquid product fractions are withdrawn and a portion of vacuum bottoms material is recycled to the second stage reactor to provide increased hydroconversion and improved yields of the light hydrocarbon liquid product.

11 Claims, 1 Drawing Figure

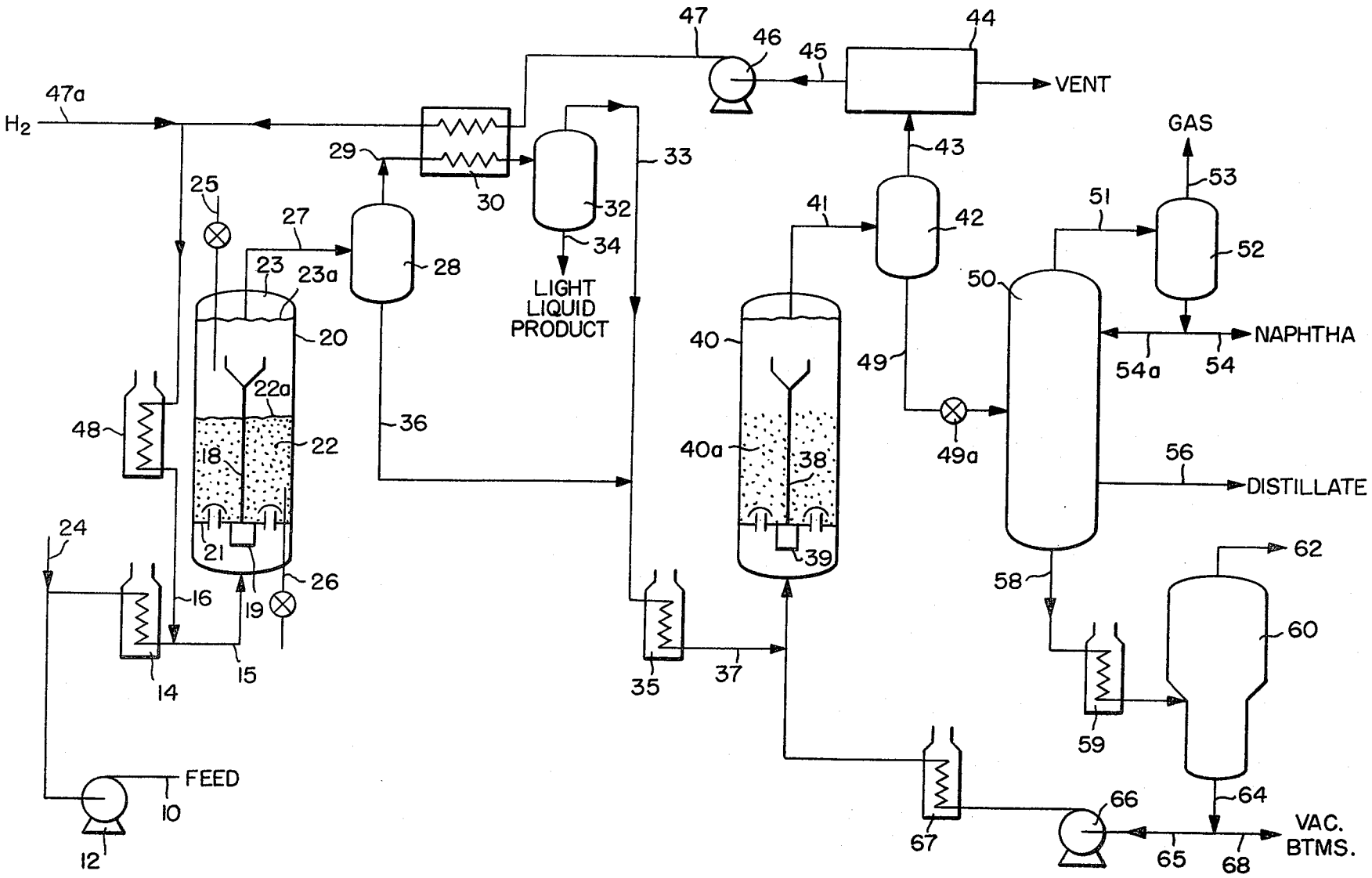
GAS
NAPHTHA
DISTILLATE
VAC. BTMS.
VENT
LIGHT LIQUID PRODUCT
FEED
$H_2$

TWO-STAGE CATALYTIC HYDROCONVERSION OF HYDROCARBON FEEDSTOCKS USING RESID RECYCLE

BACKGROUND OF INVENTION

This invention pertains to an improved two-stage catalytic hydroconversion process for hydrocarbon feedstocks. It pertains particularly to such a two-stage process for petroleum feedstocks containing fine particulate solids in which the second-stage reactor uses less severe conditions and larger size catalyst than for the first stage reactor.

In the hydroconversion of heavy petroleum feedstocks using two-stages of catalytic reaction to produce lower boiling hydrocarbon liquid products, all the liquid fraction from the first stage is usually passed through the second stage reaction, which results in excesssive conversion of lower boiling liquids in order to obtain adequate high conversion of the high boiling fractions. Examples of such two-stage processes for petroleum feedstocks are disclosed in U.S. Pat. No. 3,418,234 to Chervenak at al, U.S. Pat. No. 3,870,623 to Johson, et al, U.S. Pat. No. 3,893,911 to Rovesti and U.S. Pat. No. 3,901,792 to Wolk et al. Also, it is usually desired to recycle a portion of the vacuum residuum material for further reaction and increased conversion to lower boiling products, as shown by U.S. Pat. No. 3,412,010 to Alpert et al. A two-stage process for hydroconversion of coal-derived liquids is disclosed by U.S. Pat. No. 3,844,933 to Wolk et al. However, for some feedstocks particularly those containing some fine particulate solids such as tar sands bitumen, a build-up of solids usually occurs in the second reactor. These problems are advantageously resolved in the present invention by withdrawing an intermediate liquid product following the first stage reaction and by using larger size catalyst in the second stage reactor.

SUMMARY OF INVENTION

The present invention provides a process for the catalytic hydroconversion of hydrocarbon feedstocks including those containing fine particulate solids, such as bitumens from tar sands and heavy coal-derived liquid fractions, to produce high yields of lower boiling hydrocarbon liquid products. The feedstock material is fed, along with hydrogen, into a first stage reactor containing an ebullated bed of particulate catalyst for hydroconversion at moderate reaction conditions. The reaction conditions are maintained at 780°-850° F. temperature, 800-3000 psig hydrogen partial pressure, and 0.3-2.5 $V_f/hr/V_r$ (volume feed per hour per volume of reactor) space velocity for hydroconverting the feed to a mixture of gas and lower boiling hydrocarbon liquid fractions and thereby achieve moderate 50-70% conversion and 50-75% desulfurization of the feed. An effluent material is withdrawn from the first-stage reactor and phase separated to separate gas from the liquid fractions and a light hydrocarbon liquid having a normal boiling range of about 180°-400° F. is withdrawn as an intermediate liquid product.

The gas and remaining hydrocarbon liquid fractions from the phase separation step are recombined, reheated as needed, and are passed to a second stage catalytic reactor maintained at less severe conditions and 20°-40° F. lower temperature than the first stage reactor for further hydroconversion and desulfurization reactions. The second stage reactor contains an ebullated bed of larger size catalyst, usually 0.050-0.070 inch effective diameter.

The second stage reactor effluent material is then phase separated to provide a hydrocarbon gas and other liquid fractions, which are then distilled to produce a medium boiling hydrocarbon liquid product usually having normal boiling range of about 400°-975° F. and also a heavy 975° F.+ vacuum bottoms material. A portion of the vacuum bottoms material is advantageously recycled to the second stage reactor to produce increased yields of the medium boiling hydrocarbon liquid product, while the remainder of the 975° F.+ vacuum bottoms material is passed to further processing steps as desired.

This process can be used for the catalytic hydroconversion of any hydrocarbon feedstock, and is particularly useful for hydroconversion of bitumens derived from tar sands and for coal-derived liquids which both contain fine particulate solids, which prevents these materials being processed in fixed bed type catalytic reactors.

BRIEF DESCRIPTION OF DRAWINGS

FIG. 1 is a flow diagram of a two-stage catalytic hydroconversion process for hydrocarbon feedstocks using ebullated bed reactors connected in series in accordance with the invention.

DETAILED DESCRIPTION OF INVENTION

The invention will now be described as used in a two-stage catalytic hydroconversion process for tar sands bitumen containing fine sand particles. As illustrated by FIG. 1, a heavy petroleum feedstock is provided at 10, pressurized by pump 12 and passed through preheater 14 for heating to at least about 500° F. The heated feedstream at 15 is fed into upflow ebullated bed catalytic reactor 20. Heated hydrogen is provided at 16, and is also introduced with the feedstock into reactor 20. The reactor 20 has an inlet flow distributor and catalyst support grid 21, so that the feed liquid and gas passing upwardly through the reactor 20 will expand the catalyst bed 22 by at least about 10% and usually up to about 50% over its settled height, and place the catalyst in random motion in the liquid. This reactor is typical of that described in U.S. Pat. No. Re. 25,770, wherein a liquid phase reaction occurs in the presence of a reactant gas and a particulate catalyst such that the catalyst bed is expanded.

The catalyst particles in bed 22 usually have a relatively relatively narrow size range for uniform bed expansion under controlled liquid and gas flow conditions. While the useful catalyst size range is between 6 and 100 mesh (U.S. Sieve Series) with an upflow liquid velocity between about 1.5 and 15 cubic feet per minute per square foot of reactor cross section area, the catalyst size is preferably particles of 6 and 60 mesh size including extrudates of approximately 0.010-0.130 inch diameter. It is also contemplated to use a once-through type operation using fine sized catalyst of about 80-270 mesh size range (0.002-0.007 inch) with a liquid space velocity in the order of 0.2-15 cubic feet per minute per square foot of reactor cross-section area. In the reactor, the density of the catalyst particles, the liquid upward flow rate, and the lifting effect of the upflowing hydrogen gas are important factors in the expansion and operation of the catalyst bed. By control of the catalyst particle size and density and the liquid and gas velocities and taking into account the viscosity of the liquid at the operating conditions, the catalyst bed 22 is expanded to have an upper level or interface in the liquid as indicated at 22a. The catalyst bed expansion should be at least about 10% and seldom more than 100% of the bed settled or static level.

The hydroconversion reaction in bed 22 is greatly facilitated by use of an effective catalyst. The catalyst used is a typical hydrogenation catalyst containing activation metal oxides selected from the group consisting of cobalt, molybdenum, nickel and tungsten and mixtures thereof, deposited on a support material selected from the group of alumina silica, and combinations thereof. If a fine-size catalyst is used in the first stage reactor, it can be effectively introduced to the reactor at connection 24 by being added to the feed in the desired concentration, as in a slurry. Catalyst may also be periodically added directly into the reactor 20 through suitable inlet connection means 25 at a rate between about 0.1 and 0.2 lbs catalyst/barrel feed, and used catalyst is withdrawn through suitable withdrawal means 26.

Recycle of reactor liquid from above the solids interface 22a to below the flow distributor 21 is usually desirable to establish a sufficient upflow liquid velocity to maintain the catalyst in random motion in the liquid and to facilitate an effective reaction. Such liquid recycle is preferably accomplished by the use of a central downcomer conduit 18 which extends to a recycle pump 19 located below the flow distributor 21, to assure a positive and controlled upward movement of the liquid through the catalyst bed 22. The recycle of liquid through internal conduit 18 has some mechanical advantages and tends to reduce the external high pressure connections needed in a hydrogenation reactor, however, liquid recycle upwardly through the reactor can alternatively be established by a recycle pump located external to the reactor.

Operability of the ebullated catalyst bed reactor system to assure good contact and uniform (iso-thermal) temperature therein depends not only on the random motion of the relatively small catalyst in the liquid environment resulting from the buoyant effect of the upflowing liquid and gas, but also requires the proper reaction conditions. With improper reaction conditions insufficient hydroconversion is achieved, which results in a non-uniform distribution of liquid flow and operational upsets, usually resulting in excessive coke deposits on the catalyst.

For the petroleum feedstocks of this invention, operating conditions needed in the reactor 20 are within the ranges of 780°–850° F. temperature, 800–3000 psig, hydrogen partial pressure, and space velocity of 0.3–2.5 $V_f/hr/V_r$ (volume feed per hour per volume of reactor). Preferred conditions are 790°–840° F. temperature, 1000–2800 psig, hydrogen partial pressure, and space velocity of 0.5–1.5 $V_f/hr/V_r$. The feedstock hydroconversion achieved is at least about 75 V % for once through type operations.

In a reactor system of this type, a vapor space 23 exists above the liquid level 23a and an overhead stream containing a mixture of both gas and liquid fractions is withdrawn at 27, and passed to hot phase separator 28. The resulting gaseous portion 29 which is principally hydrogen is cooled by heat exchanger 30, and further phase separated at 32. A light hydrocarbon liquid product usually having a normal boiling range of 180°–400° F. is removed from separator 32 at 34, and the resulting gas fraction 33 is combined with the remaining heavy hydrocarbon liquid fraction 36.

From phase separator 28, liquid fraction stream 36 is withdrawn and together with gas stream 33 is reheated at heater 35 and passed into second stage reactor 40 containing an ebullated bed of catalyst 40a, which catalyst is usually somewhat larger than used in reactor 20 and preferably has particle size of 0.050–0.070 inch effective diameter. Operation of this ebullated bed reactor 40 is quite similar to that of reactor 20, with reactor liquid being recirculated through downcomer conduit 38 and pump 39 to assure positive expansion and ebullation of the catalyst bed. The operating conditions used in reactor 40 are 760°–840° F. temperature, 800–3000 psig hydrogen partial pressure, and 0.2–2.5 $V_f/Hr/V_r$ space velocity. Preferred conditions are 770°–835° F. temperature, 1000–2800 psig hydrogen partial pressure, and 0.4–2.0 $V_f/Hr/V_r$ space velocity.

From reactor 40, an effluent stream 41 containing gas and lower boiling liquid fraction is withdrawn and phase separated at 42. The resulting gas fraction 43 contains principally hydrogen which is recovered in gas purification step 44. The recovered hydrogen at 45 is usually recycled by compressor 46 through conduit 47, warmed at heat exchanger 30 and reheated at heater 48 as needed, then is introduced into the bottom of reactor 20 along with make-up hydrogen at 47a as needed.

From separator 42, the remaining liquid fraction 49 is pressure-reduced at 49a to pressure below about 200 psig, and passed to fractionation step 50, from which is withdrawn a low pressure gas stream 51. This vapor stream is phase separated at 52 to provide low pressure gas 53 and liquid stream 54 to provide reflux liquid 54a to fractionator 50 and a naphtha product stream 54. A middle boiling range distillate liquid product stream is withdrawn at 56, and a heavy hydrocarbon liquid stream is withdrawn at 58.

From fractionator 50, the heavy oil stream 58 which usually has normal boiling temperature range of 700°–975° F., is reheated as needed in heater 59 and passed to vacuum distillation step 60. A vacuum gas oil product stream is withdrawn at 62, and a vacuum bottoms stream is withdrawn at 64. A portion 65 of the vacuum bottoms material usually boiling above about 975° F. is usually pressurized at 66, reheated at heater 67 and recycled to reactor 40 for further hydroconversion, such as to achieve 85–90 V % conversion to lower boiling hydrocarbon materials. Depending on the percent conversion and products desired, up to about 90 V % of the vacuum bottoms material at 65 may be recycled to reactor 40, The volume ratio of the recycled 975° F.+ material to the feedstock should be within the range of about 0.2–1.5. A heavy vacuum pitch material is withdrawn at 68 for further processing as desired.

This invention will be better understood by reference to the following example of hydroconversion operations, and which should not be regarded as limiting the scope of the invention.

EXAMPLE 1

A bituminous feed material derived from Athabasca tar sands containing fine particulate solids as shown in Table 1 is provided.

TABLE 1

| Characteristics of Athabasca Bitumen Feed | |
|---|---|
| Inspections | |
| Gravity, °API | 9.0 |

TABLE 1-continued

| Characteristics of Athabasca Bitumen Feed | |
|---|---|
| Carbon, W % | 83 |
| Hydrogen, W % | 10.8 |
| Sulfur, W % | 4.6 |
| Solids, W % | 0.7-4.5 |
| Feed Composition, V % | |
| IBP-650° F. | 16.6 |
| 650-975° F. | 33.4 |
| 975° F. plus | 50.0 |

The material is preheated to 600° F. and fed with hydrogen into an ebullated bed catalytic reactor for initial hydroconversion reactions. The partially converted material is withdrawn and phase separated to provide a light liquid product having normal boiling range of 180°-400° F. and containing kerosene and some naphtha. The remaining heavier liquid fraction and gas which is principally hydrogen are recombined at the existing high pressure and passed to a second ebullated bed catalytic reactor for further hydroconversion reactions at essentially the same conditions. The resulting material is then phase separated and distilled at low pressures to yield desired low boiling hydrocarbon liquid products. The reaction conditions and the yield results as compared with a conventional two-stage catalytic hydroconversion process for the same feed material are presented in Table 2.

TABLE 2

| CONVERSION OPERATIONS ON HEAVY HYDROCARBON FEEDSTOCKS | Conventional 2-Stage Process | This Invention |
|---|---|---|
| Feed Material | Athabasca Tar Sands Bitumen | |
| Normal boiling range, °F. | 400-1050° F. | |
| Feed Rate, bbl/day | 10,000 | 10,000 |
| First Stage Reactor Conditions | | |
| Temperature, °F. | 835 | 835 |
| $H_2$ Partial Pressure, psig | 1250 | 1250 |
| Catalyst Used | Cobalt Moly on Alumina 0.032 inch extrudates | 0.032 inch extrudates |
| Second Stage Reactor Conditions | | |
| Temperature, °F. | 835 | 835 |
| $H_2$ Partial Pressure, psig | 1200 | 1200 |
| Catalyst Used | Cobalt Moly on Alumina 0.032 inch extrudates | 0.062 inch extrudates |
| Recycle Ratio | 0 | 0.4* |
| Product Yields, V % | | |
| $C_1$-$C_3$ Gas | 4.2 | 4.4 |
| $C_4$-400° F. Naphtha | 25.2 | 24.0 |
| 400-650° F. Lt. Distillate | 38.3 | 34.0 |
| 650-975° F. Heavy Distillate | 30.0 | 42.0 |
| 400-975° F. Liquid | 68.3 | 76.0 |
| 975° F. + Residuum | 10.3 | 4.5 |
| Wt. Percent Conversion | 80 | 91.2 |

*Recycle of vacuum bottoms material to second stage reactor, based on feed.

From the above results, it is seen that a significantly higher percentage conversion of the 975° F. + material is achieved, along with higher yields of 400°-975° F. products with the present invention than with a conventional two-stage catalytic hydroconversion processes.

Although this invention has been described broadly and in terms of a preferred embodiment, it will be understood that modifications and variations can be made within the spirit and scope of the invention, which is defined by the following claims.

I claim:

1. A process for catalytic hydroconversion of hydrocarbon feedstocks to lower boiling hydrocarbon liquids and gas, comprising:

(a) feeding a hydrocarbon feedstock containing fine particulate solids with hydrogen into a reactor containing an ebullated bed of particulate catalyst, said reactor being maintained at 780°-850° F. temperature, 800-3000 psig hydrogen partial pressure, and 0.3-2.5 $V_f$/hr/$V_f$ space velocity for hydroconverting said feedstock to a mixture of hydrocarbon gas and lower boiling hydrocarbon liquid fractions;

(b) phase separating said gas from said liquid fractions and withdrawing from said liquid fractions a light hydrocarbon liquid product having a normal boiling range of 180°-400° F.;

(c) combining said gas with the remaining liquid fractions from said separation and passing the combined material to a second stage reactor containing an ebullated bed of particulate catalyst and further hydroconverting the material to hydrocarbon gas and other lower boiling liquid fractions;

(d) separating said hydrocarbon gas from said other liquid fractions and withdrawing said other liquid fractions;

(e) distilling said other liquid fractions to produce a medium boiling hydrocarbon liquid product having normal boiling range of 400°-975° F. and also a 975° F.+ vacuum bottoms material; and (f) recycling a portion of said vacuum bottoms material to said second stage ebullated bed reactor to produce increased yields of said medium boiling hydrocarbon liquid product.

2. The process of claim 1, wherein the combined feed material to said second stage reactor is reheated to a temperature not exceeding about 750° F.

3. The process of claim 1, wherein the second stage reaction conditions are 760°-840° F. temperature, 800-3000 psig hydrogen partial pressure, and 0.2-2.5 $V_f$/hr/$V_r$ space velocity.

4. The process of claim 1, wherein said first stage reactor contains catalyst particles having 0.025–0.035 inch effective diameter and said second stage reactor contains catalyst particles having 0.050–0.070 inch effective diameter.

5. The process of claim 1, wherein the catalyst replacement rate for said first stage reactor is 0.1–0.3 pounds/barrel feed.

6. The process of claim 1, wherein the catalyst replacement rate for second stage reactor is 0.1–0.5 times that for said first stage reactor.

7. The process of claim 1, wherein said first stage reaction conditions are 790°–840° F. temperature, 1000–2800 psig hydrogen partial pressure and 0.5–1.5 $V_f/hr/V_r$ space velocity.

8. The process of claim 1, wherein the recycled vacuum bottoms material is 0.2–1.5 times the feedstock.

9. The process of claim 1, wherein the feedstock is bitumen from tar sands.

10. The process of claim 1, wherein the feedstock is coal-derived liquid normally boiling above about 650° F.

11. A process for catalytic hydroconversion of hydrocarbon feedstocks containing fine particulate solids, comprising:

(a) feeding a hydrocarbon feedstock with hydrogen into a reactor containing an ebullated bed of catalyst particles having 0.025–0.035 inch effective diameter, said reaction conditions being maintained at 780°–850° F. temperature, 800–3000 psig hydrogen partial pressure, and 0.3–2.5 $V_f/hr/V_r$ space velocity for hydroconverting said feedstock to a mixture of hydrocarbon gas and lower boiling liquid fractions;

(b) separating said gas from said liquid fractions and withdrawing a light hydrocarbon liquid product having a normal boiling range of 180°–400° F.;

(c) combining said gas with said heavy liquid fraction from said separation and feeding the combined material to a second stage reactor containing an ebullated bed of catalyst particulates having 0.050–0.070 inch effective diameter and further hydroconverting the material to produce hydrocarbon gas and other lower boiling liquid fractions;

(d) separating said hydrocarbon gas from said other liquid fractions and then withdrawing said other liquid fractions;

(e) distilling said other liquid fractions to produce a medium boiling hydrocarbon liquid product having normal boiling range of 400°–975° F. and also a 975° F.+ vacuum bottoms stream; and (f) recycling a portion of said vacuum bottoms material to said second stage ebullated bed reactor to produce increased yields of said medium boiling hydrocarbon liquid product.

* * * * *